US005685492A

United States Patent [19]

Davis et al.

[11] Patent Number: 5,685,492

[45] Date of Patent: *Nov. 11, 1997

[54] FUEL INJECTOR NOZZLES

[75] Inventors: Robert Max Davis, Dunsborough; Jorge Manuel Pereira Dasilva, North Beach, both of Australia

[73] Assignee: Orbital Engine Company (Australia) Pty. Limited, Balcatta, Australia

[ * ] Notice: The term of this patent shall not extend beyond the expiration date of Pat. No. 5,593,095.

[21] Appl. No.: 465,272

[22] Filed: Jun. 5, 1995

Related U.S. Application Data

[63] Continuation-in-part of Ser. No. 402,399, Mar. 10, 1995, Pat. No. 5,593,095, which is a continuation of Ser. No. 194,306, Feb. 4, 1994, abandoned, which is a continuation of Ser. No. 768,841, Sep. 26, 1991, abandoned.

[30] Foreign Application Priority Data

Jan. 26, 1990 [AU] Australia ..... PJ9341

[51] Int. Cl.[6] ..... F02M 61/08

[52] U.S. Cl. ..... 239/584; 239/533.12

[58] Field of Search ..... 239/533.2–.7, 239/533.9, 533.11, 533.12, 584

[56] References Cited

U.S. PATENT DOCUMENTS

| | | | |
|---|---|---|---|
| 4,408,722 | 10/1983 | Frelund | 239/453 |
| 4,523,719 | 6/1985 | Hofmann | 239/533.12 |
| 5,090,625 | 2/1992 | Davis | 239/533.12 |

FOREIGN PATENT DOCUMENTS

| | | |
|---|---|---|
| 3737 896 A1 | 5/1989 | Germany . |
| 2 094 398 | 9/1982 | United Kingdom . |
| 2 112 455 | 7/1983 | United Kingdom . |
| 2 146 068 | 4/1985 | United Kingdom . |

*Primary Examiner*—Andres Kashnikow
*Assistant Examiner*—Lisa Ann Douglas
*Attorney, Agent, or Firm*—Nikaido, Marmelstein, Murray & Oram LLP

[57] ABSTRACT

An internal combustion engine fuel injector having a selectively openable nozzle (10) through which a fuel is delivered to the combustion chamber of the engine. The nozzle (10) comprises a port (12) having an internal annular surface (13) and a valve member (20) having an external annular surface coaxial with respect the internal annular surface. Sealing contact between the valve member and the port is provided therebetween along a circular seat line substantially coaxial to the respective annular surfaces. The annular surfaces are configured so that when the internal and external annular surfaces are in sealing contact along the circular seat line, the seat line is located adjacent the downstream end of the passage for delivery of fuel with respect to the direction of the flow of fuel through the passage. The maximum width of the passage between the annular surfaces is not substantially more than 30 microns.

18 Claims, 2 Drawing Sheets

Fig. 3
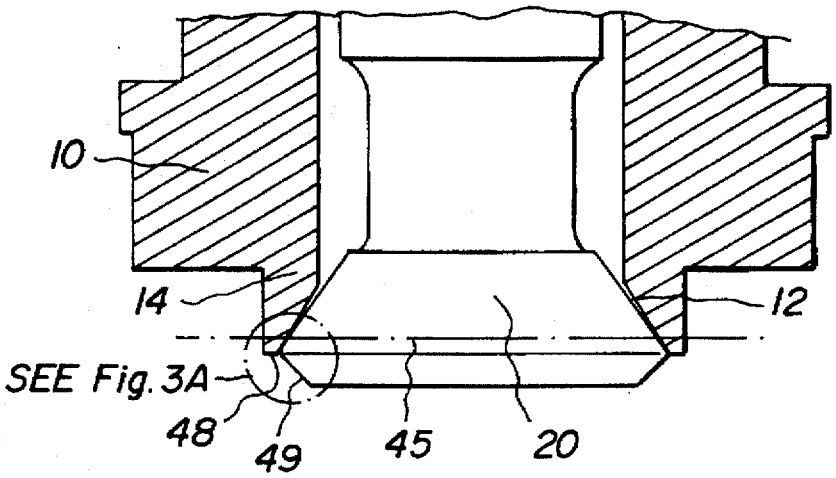
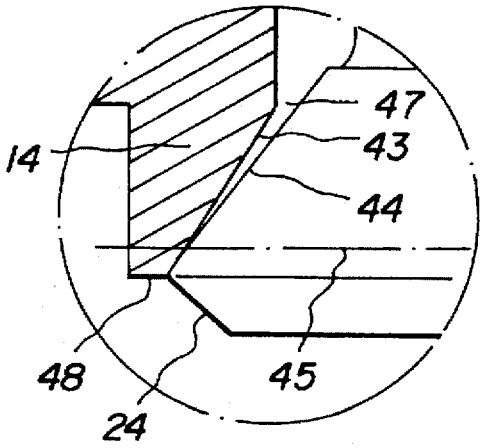
Fig. 3A

FUEL INJECTOR NOZZLES

This application is a Continuation-in-part Application of application Ser. No. 08/402,399, filed Mar. 10, 1995, now U.S. Pat. No. 5,593,095 which in turn is a Continuation of application Ser. No. 08/194,306 filed Feb. 4, 1994, now abandoned which is a continuation of application Ser. No. 07/768,841, filed Sep. 26, 1991, now abandoned.

This invention relates to a valve controlled nozzle for the injection of fuel in an internal combustion engine. In this specification, the term "internal combustion engine" is to be understood to include engines having an intermittent combustion cycle, such as reciprocating or rotary engines, and does not include continuous combustion engines such as turbines.

The characteristics of the fuel spray delivered from an injector nozzle to an internal combustion engine, such as directly into the combustion chamber, have a major effect on the efficiency of the burning of the fuel, which in turn affects the stability of the operation of the engine, the engine fuel efficiency and the composition of the engine exhaust gases. To optimise these effects, particularly in a spark ignited engine, the desirable characteristics of the spray pattern of the fuel issuing from the nozzle include small fuel drop size (liquid fuels), controlled geometry and in the case of direct injected engines, controlled penetration of the fuel spray into the combustion chamber. Further, at least at low fuelling rates, a relatively contained and evenly distributed ignitable cloud of fuel vapour in the vicinity of the engine spark plug is desirable.

Some known injection nozzles, used for the delivery of fuel directly into the combustion chamber of an engine, are of the outwardly opening poppet valve type, which deliver the fuel in the form of a cylindrical or divergent conical spray composed of fuel droplets. The nature of the shape of the liquid fuel spray is dependent on a number of factors including the geometry of the port and valve constituting the nozzle, especially the surfaces of the port and valve immediately adjacent the seat where the port and valve engage to seal when the nozzle is closed. Once a nozzle geometry has been selected to give the required performance of the injector nozzle and the combustion process, it is important to maintain such geometry otherwise the performance of the engine could be impaired, particularly at low fuelling rates.

In particular, the attachment or build-up of solid combustion products or other deposits on the nozzle surfaces over which the fuel flows can affect the geometry of the nozzle and can therefore affect the creation of the correct fuel distribution and hence combustion process of the engine. The principal cause of build-up on these surfaces is the adhesion thereto of carbon related or other particles that may be produced by the combustion or partial combustion or residual fuel droplets or film left on these surfaces between injection cycles, or by carbon related particles produced in the combustion chamber during combustion.

The build-up of such deposits on these surfaces can also adversely affect the metering performance of an injector nozzle where the metering of the fuel is carried out at the injector nozzle. The existence of deposits can directly reduce the cross-sectional area of the fuel path through the nozzle when open, and/or cause eccentricity between the valve and the port of the nozzle thereby varying the cross-sectional area of the fuel path. The extent of these deposits can also be such that correct closing of the injector nozzle cannot be achieved and can thus lead to continuous leakage of fuel through the nozzle into the combustion chamber. This leakage would have severe adverse effects on the emission level in the exhaust gases and possibly result in instability in the engine operation.

It is therefore an object of the present invention to provide a nozzle, through which fuel is Injected In an internal combustion engine, that will contribute to a reduction in the build-up of deposits in the path of fuel being delivered to the engine, and hence improve the performance of the nozzle while in service.

With this object in view there is provided an internal combustion engine fuel injector having a selectively openable nozzle through which fuel is delivered to a combustion chamber of the engine, said nozzle comprising a port having an internal annular surface and a valve member having an external annular surface co-axial with respect to the internal annular surface, said valve member being axially movable relative to the port to selectively provide between said internal and external annular surfaces a continuous passage for the delivery of fuel therethrough or sealing contact therebetween along a circular seat line substantially co-axial to the respective annular surfaces to prevent the delivery of fuel therebetween, said annular surfaces being relatively configured so that when the internal and external annular surfaces are in sealing contact along said circular seat line said seat line is located adjacent the downstream end of the passage with respect to the direction of the flow of fuel through the passage, and the maximum width of the passage between said annular surfaces is not substantially more than 30 microns.

The maximum width of the passage is preferably not substantially more than about 20 microns.

Preferably, the body in which the port is formed and the valve member have respective terminal faces at the downstream end of the internal and external annular surfaces that are substantially normal to the respective annular surfaces. Preferably the terminal faces are substantially at right angles plus or minus 10° to the respective annular surfaces.

Conveniently, the terminal faces of the body and valve member are substantially co-planar when the valve member is seated in sealing contact against the port along the circular seat line, or at least neither of the annular surfaces substantially overhang or extend beyond the extremity of the other at the downstream end, when the valve member is seated.

The length of at least one of the internal and external annular surfaces is preferably between about 0.50 and 2.0 mm and conveniently between 0.80 and 1.50 mm.

Conveniently, the internal and external annular surfaces are inclined to the common axis thereof at respective angles so that they diverge from the circular seat line upstream with respect of the direction of the flow of the fuel during delivery.

The internal and external annular surface can conveniently be of truncated conical form, although the external annular surface of the valve member may be arcuate in axial section presenting a convex, conveniently part spherical, face to the internal annular surface of the port. The use of the convex face assists in manufacture in obtaining the desired location of the circular seat line sealing between the port and valve member.

The above described relationship of the internal and external surfaces has been proved in testing to maintain the desired spray formation of the injected fuel and desired performance of the nozzle over longer periods than previously achieved. It is suggested that the reduced maximum dimension of the gap between the annular surfaces of the circular seat line may generate an impact load on any deposit each time the nozzle closes. This impact load is believed to dislodge the deposit and so prevent the build-up of deposits on the opposed annular surfaces.

Also, the arranging of the terminal surfaces of the port and valve member substantially at right angles to the respective annular surfaces, results in any extension of deposits on the terminal surfaces into the path of the fuel being in the direct path of the fuel and so subject to the maximum impingement force from the fuel to promote breaking off of such extensions of the deposits. The development of such overhanging deposits is also inhibited by the respective terminal surfaces being co-planar when the valve member is seated in the port.

The invention will be more readily understood from the following description of three practical arrangements of a fuel injector nozzle incorporating an embodiment of the present invention as illustrated in the accompanying drawings.

In the drawings:

FIG. 3 is a view as in FIG. 1 with an alternative valve configuration.

Figure 1:
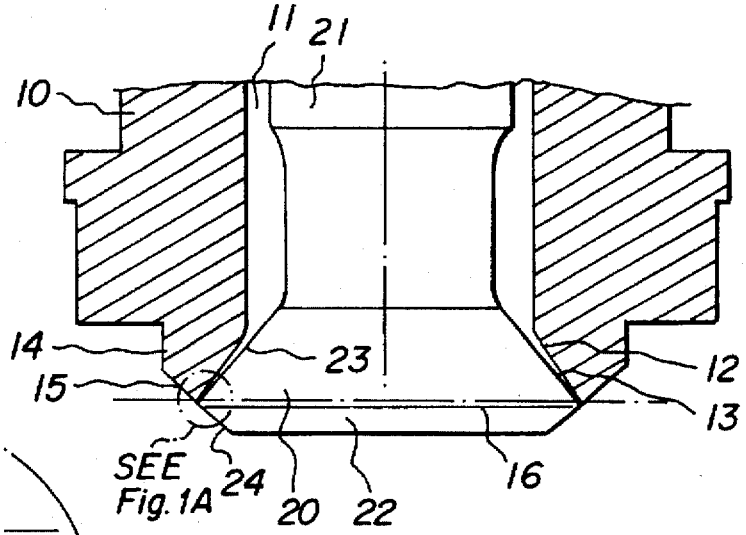
FIG. 1 is an axial section view of a nozzle port and valve in the closed position.
Figure 1A:
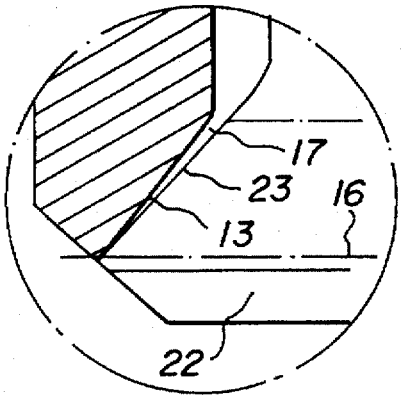
Figure 2:
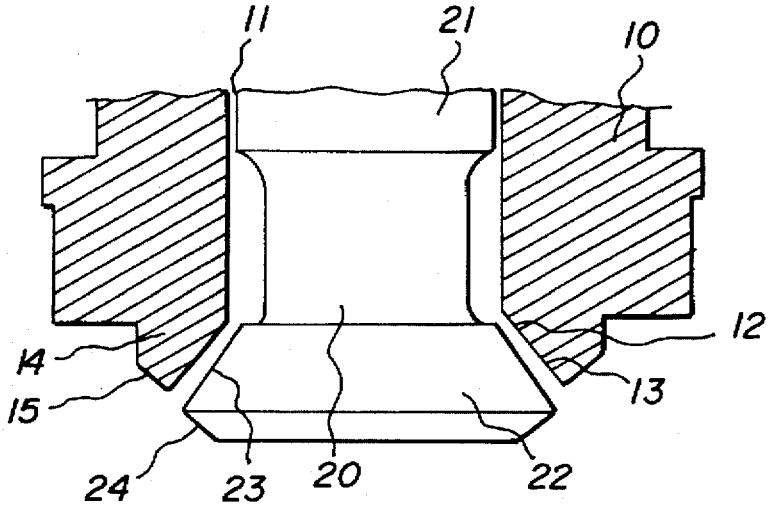
FIG. 2 is a view as in FIG. 1 with the valve in the open position.

Referring now to FIGS. 1 and 2, the nozzle body 10 has in the lower portion thereof an axial bore 11 therethrough terminating in a port 12, having an internal annular surface 13. Surrounding the port 12 is a projecting ring 14 having a terminal surface 15 which intersects the internal annular surface 13 at right angles.

The valve member 20 has a stem 21 with an integral valve head 22 at one end. The stem 21 co-operates with a suitable mechanism to axially reciprocate in the nozzle body 10 to selectively open and close the nozzle. Fuel, preferably entrained in a gas such as air, is supplied through the bore 11 to be delivered to an engine when the nozzle is open. The fuel may be metered as it is delivered through the nozzle or may be supplied in metered quantities to the bore 11.

The valve head 22 has an external annular surface 23, diverging outwardly from the stem 21, and a terminal face 24 converging from the extremity of the annular surface 23. The surfaces 23 and 24 are each of truncated conical form and intersect substantially at right angles.

The cone angle of the annular surface 23 is less than that of the annular surface 13 of the nozzle body 10 so that the surfaces converge with respect to each other in the direction towards the terminal faces 15 and 24 respectively. The angles and diameters of the surfaces 13 and 23 are selected so that the valve head 22 is seated at the junction of the terminal face 15 and the internal annular surface 13 of the port 12. The circular seat line is indicated In FIG. 1 on the valve head 22 at 16. The length of the surfaces 13 and 23 are selected so that when the valve head 22 is seated in the pod 12, the respective terminal surfaces 15 and 24 are substantially aligned. This can conveniently be achieved by grinding these surfaces after assembly of the valve member 20 to the nozzle body 10.

The selection of the angles of the annular surfaces 13 and 23 and the length of each surface upstream of the seat line 16 determines the width of the annular gap 17 between them at the upper extremity thereof. In order to achieve the advantage of controlling the build-up of deposits between these surfaces, the width of the annular gap 17, when the valve member 20 is seated, is not to be substantially more than 30 microns. This can also be achieved by grinding the terminal faces 15 and 24 after assembly.

In one practical form of the nozzle, the cone angles of the internal annular surface 13 and external annular surface 23 are 39° and 40° respectively, with the diameter of the bore 11 and the maximum diameter of the outer end of the valve head 22 selected so that the gap 17 is about 20 microns at the upper extremity, with the length of the internal surface 13 of the port being about 1.35 min.

It is to be understood that other nominal seat angles for the nozzle can be used and may be within the range of 20° to 60°, preferably in the range 30° to 50°, Also, the length of the internal surface 13 of the port should not exceed 2.00 mm and is preferably between 0.8 and 1.5 mm.

In the embodiment shown in FIG. 3, the terminal face 48 of the port 12 is substantially inclined to the terminal face 24 of the valve member 20. This inclination of the terminal face 48 together with a reduced diameter of the ring 14 results in only a relatively small mass of metal at the tip of the body 10 will in use maintain a high temperature and therefore burn off any particles deposited thereon.

In an alternative construction, the external annular surface 23 of the valve head 22 is not conical as in FIGS. 1 and 2, but is convex, conveniently arcuate, in cross section. The contour of the converse annular surface may be selected in relation to the internal annular surface 13 so as to locate the circular seat line 16 spaced from the junction of the terminal face 15 and the internal annular surface 13, and so that the gap 17 between the internal and external surfaces 13 and 23 progssively increases from the seat line 16 to the junction of the bore 11 and the internal annular surface 13. Again, the width of the gap 17 at the upper extremity of the internal annular surface 13 is of the order of 20 microns when the valve member 20 is seated. The convex surface may be part of a sphere or a blend of two or mor port-spherical surfaces, and is symmetrical with respect to the axis of the valve member 20. In a further modification, the internal annular surface 13 of the port may be concave and the external annular surface 23 of the valve head 22 may be convex.

Each of the embodiments of the nozzle described have an outwardly opening valve member, commonly referred to as a popper valve, however, the invention is equally applicable to inwardly opening valve members, commonly referred to as pintel valves.

The above described nozzle may be used in any form of fuel injector using a popper type valve, and may be used for injecting either liquid or gaseous fuels, alone or in combination, and with or without entrainment of the fuel in a gaseous carder, such as compressed air.

The claims defining the invention are as follows:

1. An internal combustion engine fuel injector having a selectively openable nozzle through which fuel is delivered to a combustion chamber of the engine, said nozzle comprising a port having an internal annular surface and a valve member having an external annular surface co-axial with respect to the internal annular surface, said valve member being axially movable relative to the port to selectively provide between said internal and external annular surfaces a continuous passage for the delivery of fuel therethrough or sealing contact therebetween along a circular seat line substantially co-axial to the respective annular surfaces to prevent the delivery of fuel therebetween, said annular surfaces-being relatively configured so that when the internal and external annular surfaces are in sealing contact along said circular seat line said seat line is located adjacent the downstream end of the passage with respect to the direction of the flow of fuel through the passage, and the maximum width of the passage between said annular surfaces is not substantially more than 30 microns.

2. A fuel injector as claimed in claim 1 wherein said valve member is selectively axially movable outwardly with respect to the port to provide said continuous passage for the delivery of fuel.

3. A fuel injector as claimed in claim 2, wherein said maximum width of said passage is not more than about 20 microns.

4. A fuel injector as claimed in claim 3, wherein the internal annular surface of the port is of a truncated conical shape and the external annular surface of the valve member is of a part spherical shape coaxial to the port internal annular surface.

5. A fuel injector as claimed in claim 4, wherein both the port and valve member each have a terminal face at the downstream end of the respective annular surfaces, said terminal faces being substantially co-planar when the two annular surfaces are in contact along the seat line.

6. A fuel injector as claimed in claim 1, wherein the internal and external annular surfaces are smoothly divergent upstream from the set line.

7. A fuel injector as claimed in claim 1, wherein at least one of the annular surfaces is of truncated conical shape.

8. A fuel injector as claimed in claim 1, wherein at least one of the annular surfaces is of part spherical shape co-axial to the other annular surface.

9. A fuel injector as claimed in claim 1, wherein at least one of the part or valve member has a terminal face at the downstream end of the annular surface thereof that is substantially normal to said annular surface.

10. A fuel injector as claimed in claim 9, wherein the internal annular surface of the port is of a truncated conical shape and the external annular surface of the valve member is of a part spherical shape co-axial to the port internal annular surface.

11. A fuel injector as claimed in claim 1, for use in a fuel injection system wherein fuel is delivered by the injector entrained in a gas.

12. A fuel injector as claimed in claim 1, wherein the Internal annular surface of the port is of a truncated conical shape and the external annular surface of the valve member is of a part spherical shape co-axial to the port internal annular surface.

13. A fuel injector as claimed in claim 1, wherein both the port and valve member each have a terminal face at the downstream end of the receptive annular surfaces, said terminal faces being substantially co-planar when the two annular surfaces are in contact along the seat line.

14. A fuel injector as claimed in claim 1, wherein said maximum width of the passage is not more than about 20 microns.

15. A fuel injector as claimed in claim 14, wherein the internal annular surface of the port is of a truncated conical shape and the external annular surface of the valve member is of a part spherical shape co-axial to the port internal annular surface.

16. A fuel injector as claimed in claim 1, wherein at least one of said annular surfaces has a length between about 0.50 and 2.00 mm.

17. A fuel injector as claimed in claim 1, wherein at least one of said annular surfaces has a length between about 0.80 and 1.50 mm.

18. A fuel injector as claimed in any one of claims 12, 15 or 10, wherein both the port and valve member each have a terminal face at the downstream end of the respective annular surfaces, said terminal faces being substantially co-planar when the two annular surfaces are in contact along the seat line.

* * * * *